United States Patent [19]

Burk

[11] 4,388,049

[45] Jun. 14, 1983

[54] FLUID SUPPLY SYSTEM USING ONE FLUID MEDIUM TO MOVE A SECOND FLUID MEDIUM

[75] Inventor: Ronnie F. Burk, Waterloo, Iowa

[73] Assignee: Deere & Company, Moline, Ill.

[21] Appl. No.: 191,964

[22] Filed: Sep. 29, 1980

[51] Int. Cl.[3] ..... F04B 17/00

[52] U.S. Cl. ..... 417/396; 91/292

[58] Field of Search ..... 91/291, 292; 417/396, 417/403, 404

[56] References Cited

U.S. PATENT DOCUMENTS 2,579,670 12/1951 Hjarpe ..... 91/291 X
2,942,553 6/1960 Moeller et al. ..... 417/396
3,016,016 1/1962 Horlacher ..... 417/396

FOREIGN PATENT DOCUMENTS 1025679 3/1958 Fed. Rep. of Germany ..... 417/396

*Primary Examiner*—Leonard E. Smith

[57] ABSTRACT

A fluid supply system includes a pump body having a main bore connectible through inlet check valves to draw secondary fluid from a first fluid reservoir and through outlet check valves to supply it to a secondary fluid function upon reciprocation of a free piston in the main bore. The free piston includes a pair of coaxial driving pistons on either side which extend into main passages which are alternately connected to a pressurized primary fluid source to cause reciprocation of the free piston. A first spool valve which responds to the completion of a free piston stroke activates a second spool valve which changes the primary fluid source connections to the driving pistons.

4 Claims, 1 Drawing Figure

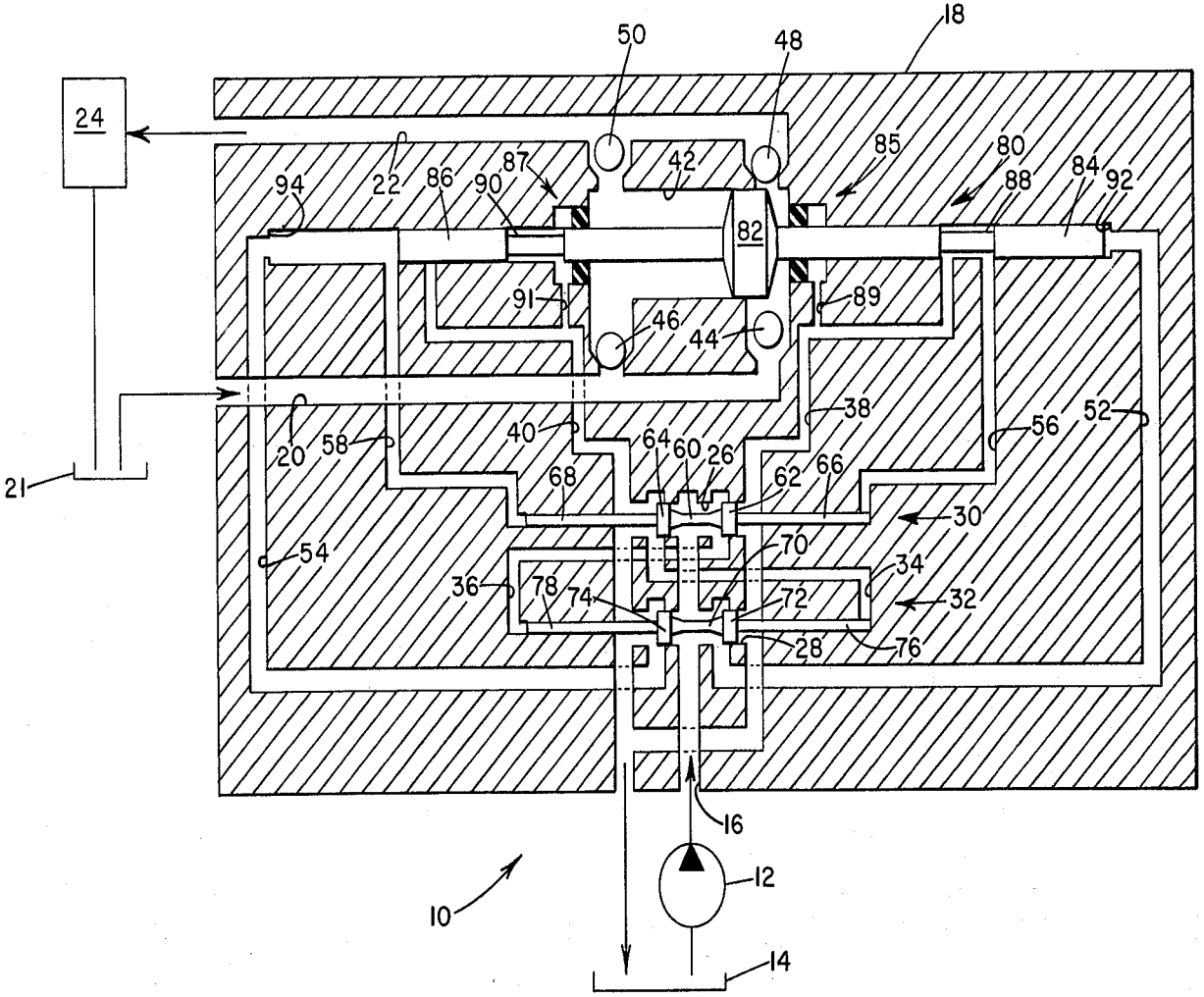
18
48
50
42
82
85
87
90
86
22
94
80
88
84
92
89
91
44
46
52
56
38
40
58
20
54
66
68
30
62
64
60
26
70
72
28
32
34
76
74
78
36
16
12
14
10
24
21

FLUID SUPPLY SYSTEM USING ONE FLUID MEDIUM TO MOVE A SECOND FLUID MEDIUM

BACKGROUND OF THE INVENTION

The present invention relates generally to secondary fluid supply pumps and more particularly to a hydraulically driven, pressure compensated, self-priming, low pressure air or freon supply pump.

In the past, complex and expensive pumps were required to obtain pressure compensated, self-priming, two fluid operation and attempts to make direct pressure-operated reciprocating piston pumps were frustrated by the imcompressibility of hydraulic fluid which would prevent totally bi-stable operation of the free piston.

SUMMARY OF THE INVENTION

The present invention provides a simple, primary fluid driven, pressure compensated, self-priming, secondary fluid supply system.

The above and additional advantages of the present invention will become apparent to those skilled in the art from a reading of the following detailed description when taken in conjunction with the accompanying drawing.

BRIEF DESCRIPTION OF THE DRAWING

The drawing is a schematic, partially in section, incorporating the preferred embodiment of the present invention.

DESCRIPTION OF THE PREFERRED EMBODIMENT

Referring now to the drawing, a fluid supply system 10 is shown having a primary fluid pump 12 for drawing a primary fluid out of a first fluid reservoir 14. The primary fluid is then pressurized by the pump 12 and supplied to a primary fluid inlet 16 in a pump body 18. In the preferred embodiment, the primary fluid is hydraulic oil.

The pump body 18 further contains a reservoir passage 20 which is fluidly connected between a second fluid reservoir 21 and a secondary fluid outlet passage 22. A secondary fluid is drawn out of the second fluid reservoir 21 and is supplied to a conventional secondary fluid function, generally designated 24. The secondary fluid can be air or freon, with the air used in an air brake system and with freon used in an air conditioning system.

Referring back to the primary fluid inlet 16 and utilizing a convention wherein the right and left hand sides of the pump body 18 are respectively on the right and left hand sides of the viewer, the primary fluid inlet 16 is medially connected to first and second bores 26 and 28 in first and second five-way valves 30 and 32, respectively.

The first bore 26 has ports immediately adjacent to the left and right of the primary fluid inlet 16 which are respectively connected to right and left pilot passages 34 and 36 and which, in turn, are directly connected to the right and left ends, respectively, of the second bore 28. Right and left relief passages 38 and 40 are respectively connected to the right and left ends of the first bore 26 as well as the right and left ends respectively of the second bore 28. The relief passages are interconnected and relieve to the first reservoir 14.

A cylindrical main bore 42 is provided in the pump body 18 and is connected to right and left inlet check valves 44 and 46 which allow the flow of fluid from the second reservoir 21 and the reservoir passage 20 into the main bore 42. The right and left inlet check valves 44 and 46 are respectively adjacent to right and left outlet check valves 48 and 50 which allow the passage of secondary fluid from the main bore 42 into the secondary fluid outlet passage 22.

Coaxial with the main bore 42 are portions of right and left main passages 52 and 54 which are connected to the second bore 28 respectively to the right and left of the primary fluid inlet 16.

Further connected to the right and left main passages 52 and 54 are right and left control passages 56 and 58 which are connected to the right and left ends respectively of the first bore 26. The right and left relief passages 38 and 40 are respectively connected to the right and left main passages 52 and 54 between the right and left control passages 56 and 58.

The first valve 30 includes a first spool 60 which has right and left lands 62 and 64 and right and left pilot pistons 66 and 68 which are slidable in coaxial portions of the right and left control passages 56 and 58, respectively. The first spool 60 is shiftable from a right position, as shown, in which the primary fluid inlet 16 is connected to the left pilot passage 36 and the left relief passage 40 is connected to the right pilot passage 34, to a second position in which the first spool 60 connects the primary fluid inlet 16 to the right pilot passage 34 and the right relief passage 38 to the left pilot passage 36.

The second valve 32 includes a second spool 70 which has right and left lands 72 and 74 and right and left pilot pistons 76 and 78 which extend into coaxial portions of the right and left pilot passages 34 and 36, respectively. The second spool 70 is movable between a right position, as shown, in which the primary fluid inlet 16 is connected to the right main passage 52 and the left relief passage 40 is connected to the left main passage 54, to a left position in which the primary fluid inlet 16 is connected to the left main passage 54 and the right relief passage 38 is connected to the right main passage 52.

The main bore 42 is part of a secondary fluid pump 80 which includes a free piston 82 which is sealingly slidable in the main bore 42. The free piston 82 includes right and left driving pistons 84 and 86 which extend into the coaxial portions of the right and left main passages 52 and 54, respectively. Between the coaxial portions of the right and left main passages 52 and 54 and the main bore 42 are right and left seal assemblies 85 and 87 which respectively encircle the right and left driving pistons 84 and 86 to prevent the mixing of the primary and secondary fluids. The right and left seal assemblies are respectively relieved to the right and left relief passages 38 and 40 by passages 89 and 91. The right and left driving pistons 84 and 86 are respectively provided with reliefs 88 and 90. The free piston 82 is movable from a right position where it is near a stop 92 to a left position where it is near a stop 94. While reciprocating, the free piston 82 should never actually strike the stops 92 and 94.

In operation, the fluid supply system 10 may be started at any position of the free piston 82 upon application of pressurized primary fluid from the primary fluid pump 12 to the primary fluid inlet 16 because the first and second valves 30 and 32 ensure bistable operation.

Starting from the position shown in the drawing, pressurized fluid in the primary fluid inlet 16 is supplied to the left pilot passage 36 by the first valve 30 which causes the second valve 32 to cause pressurized fluid from the primary fluid inlet 16 to pressurize the right main passage 52. Pressurization of the right main passage 52 causes the right driving piston 84 to start moving the free piston 82 to the left.

Leftward movement of the free piston 82 causes the right inlet check valve 44 to open to draw secondary fluid into the main bore 42. Simultaneously, the left outlet check valve 50 is opened to allow secondary fluid in the main bore 42 to exit to the secondary fluid function 24. As would be evident to those skilled in the art, with proper sealing between the free piston 82 and the main bore 42, the secondary fluid pump 80 will be self-priming.

With the free piston 82 starting to move to the left, it will be noted that the left control passage 58, the left main passage 54, and the right pilot passage 34 are all connected to the left relief passage 40 and thence to the first reservoir 14. Also, it will be seen that the right control passage 56 is connected to the first reservoir 14 via the relief 88 and the relief passage 38.

As the free piston 82 continues to the left, the right driving piston 84 will allow fluid communication between the pressurized right main passage 52 and the right control passage 56. However, since the left driving piston 86 will block the left control passage 58, movement of the first spool 60 will be prevented and subsequently movement of the second spool 70 will also be prevented.

When the free piston 82 approaches the second stop 94, the left control passage 58 will be placed in fluid communication with the left relief passage 40 via the relief 90. At this point, the pressurized primary fluid in the right control passage 56 from the right main passage 52 acting on the right pilot piston 66 will cause the first spool 60 to shift to its left position while the free piston 82 continues towards the position in which it approaches but never contacts the second stop 94. When the first spool 60 of the first valve 30 reaches the left position, pressurized primary fluid from the primary fluid inlet 16 is supplied to the right pilot passage 34 to cause a shift in the second valve 32 of the second spool 70 to its left position also.

It should be noted that the first and second valves 30 and 32 when reciprocating provide fluid to the portion of the main bore 42 which is connected to the secondary fluid function 24 so that the displacement of the first and second valves 30 and 32 is added to the secondary fluid due to the free piston 82. It should also be noted that the reliefs 88 and 90 can be changed in size so that the fluid supply system 10 could operate when the features described in the preceding two paragraphs were reversed or simultaneous.

As would be evident to those skilled in the art, with the free piston 82 and the first and second valves 30 and 32 in their left positions, the second half of a cycle similar to the above described first part of the cycle begins. Secondary fluid is drawn through the left inlet check valve 46 from the second reservoir 21 and pumped from the main bore 42 through the right outlet check valve 48 to the secondary fluid function 24.

It should be noted that with a constant supply pressure at inlet 16, the above fluid system 10 would by nature be pressure compensated. The free piston 82 and the right and left driving pistons 84 and 86 would have forces acting in opposition and the resulting forces would accelerate the mass of these pistons thus increasing the output of the pump when the pressure drops. The mass of the system would come to equilibrium at some pressure that produced a zero resultant force. As would be evident to those skilled in the art, flow restriction losses inside the system 10, itself, would form part of the pressure load on the free piston 82 and there would be a limiting available acceleration force corresponding to zero pressure at the secondary fluid outlet passage 22. Naturally, the fluid system 10 should be designed such that acceleration of the pistons take a small portion of the cycle. This can be accomplished by increasing the displacement of the free piston 82, reducing the mass of the pistons and spools, and minimizing flow restrictions.

While the invention has been described in conjunction with a specific embodiment, it is to be understood that many alternatives, modifications and variations will be apparent to those skilled in the art in light of the aforegoing description. For example, one pair of check valves 46 and 50 could be connected to one fluid circuit and the second pair of check valves 44 and 48 could be connected to another different fluid circuit with the free piston 82 being driven by a third fluid circuit containing a different fluid from the other two fluids. Accordingly, it is intended to embrace all such alternatives, modifications, and variations which fall within the spirit and scope of the appended claims.

I claim:

1. A secondary fluid supply system connectible to a source of primary fluid, a first fluid reservoir of primary fluid, a second fluid reservoir of secondary fluid, and a secondary fluid function, said secondary fluid supply system comprising:

(a) a pump body;

(b) a main bore enclosed within said pump body having respective first and second ends;

(c) first and second bores enclosed within said pump body having respective first and second ends;

(d) an inlet into said pump body connecting said source of primary fluid to said first and second bores between said respective first and second ends thereof;

(e) first and second pilot passages enclosed within said pump body respectively connecting said first bore proximate said first end to said second end of said second bore, and said first bore proximate said second end to said first end of said second bore;

(f) first and second main passages enclosed within said pump body respectively connecting said second bore proximate said first end to said first end of said main bore, and connecting said second bore proximate said second end to said second end of said main bore;

(g) first and second control passages enclosed within said pump body respectively connecting said first and second ends of said first bore to said first and second main passages approximately at said ends of said main bore;

(h) first and second relief passages enclosed within said pump body respectively connecting said first ends of said first and second bores to said first main passage between said first control passage and said first end of said main bore and said second ends of said first and second bores to said second main passage between said second control passage and said second end of said main bore;

(i) a secondary fluid reservoir passage enclosed within said pump body connecting said second fluid reservoir to both said first and second ends of said main bore;

(j) a secondary fluid passage enclosed within said pump body connecting said secondary fluid pressure function to both said first and second ends of said main bore;

(k) first and second reservoir check valves respectively disposed in said reservoir passage proximate said first and second ends of said main bore for preventing secondary fluid from flowing from said main bore into said reservoir passage;

(l) third and fourth check valves respectively disposed in said secondary fluid pressure function passage proximate said first and second ends of said main bore for preventing secondary fluid from flowing from said secondary fluid pressure function into said main bore;

(m) a first spool valve positioned within said first bore and extending into both said first and second control passages, said first spool valve being movable in response to primary fluid in said second control passage to connect said primary fluid from said source to said second pilot passage and said second relief passage to said first pilot passage and in said first control passage to connect said primary fluid from said source to said first pilot passage and said second relief passage to said second pilot passage;

(n) a second spool valve positioned within said second bore and extending into both said first and second pilot passages, said second spool valve being movable in response to primary fluid in said second pilot passage to connect said source to said first main passage and said second relief passage to said second main passage and to primary fluid in said first pilot passage to connect said source to said second main passage and said first relief passage to said first main passage; and (o) a free piston positioned within said main bore and extending into said first and second main passages, said free piston responding to pressurized primary fluid present in said first main passage to move from a first position connecting said first and second control passages to said first fluid reservoir and said second bore through a series of positions drawing fluid from said reservoir through said first reservoir check valve and supplying fluid from said main bore through said second outlet check valve while respectively blocking said first and second control passages from said first and second main passages to a second position respectively connecting said first and second control passages to said second bore and to said first fluid reservoir, said free piston responsive to primary fluid in said second main passage to move from said second position through a series of positions drawing fluid from said reservoir through said second reservoir check valve and supplying fluid from said main bore through said first outlet check valve to said first position.

2. The secondary fluid supply system of claim 1 including first and second seals are positioned between said first and second main passages and said first and second ends of said main bore, respectively, for sealing said primary fluid from said secondary fluid.

3. A secondary fluid supply system connectible to a primary fluid pump, a first fluid reservoir of primary fluid, a second fluid reservoir of secondary fluid, and a secondary fluid function, said secondary fluid supply system comprising:

(a) a pump body;

(b) a cylindrical main bore enclosed within said pump body having first and second ends;

(c) first and second bores enclosed within said pump body having respective first and second ends;

(d) a primary fluid inlet into said pump body connecting said primary fluid pump to said first and second bores medially between said respective first and second ends thereof;

(e) first and second pilot passages enclosed within said pump body respectively connecting said first bore between said primary fluid inlet and said second relief passage to said first end of said second bore and said first bore between said primary fluid inlet and said first relief passage to said second end of said second bore;

(f) first and second main passages enclosed within said pump body respectively connecting said second bore between said primary fluid inlet and said first relief passage to said first end of said main bore and said second bore between said primary fluid inlet and said second relief passage to said second end of said main bore;

(g) first and second control passages enclosed within said pump body respectively connecting said first and second ends of said first bore to said first and second main passages respectively proximate said first and second ends of said main bore;

(h) first and second relief passages enclosed within said pump body respectively connecting said first ends of said first and second bores to a first main passage between a first control passage and said first end of said main bore and said second ends of said first and second bores to a second main passage between a second control passage and said second end of said main bore;

(i) a reservoir passage enclosed within said pump body connectible to said second fluid reservoir;

(j) a secondary fluid outlet passage enclosed within said pump body connectible to said secondary fluid function;

(k) first and second reservoir check valves respectively connecting said reservoir passage to said first and second ends of said main bore and allowing secondary fluid into said main bore;

(l) third and fourth check valves respectively connecting said secondary fluid outlet passage to said first and second ends of said main bore and allowing secondary fluid out of said main bore;

(m) a first spool valve slidably positioned within said first bore and having first and second ends, said first spool valve having first and second pilot pistons respectively extending from said first and second ends and respectively extending into said first and second control passages, said first spool valve being movable in response to primary fluid in said second control passage to connect said primary fluid source to said second pilot passage and said second relief passage to said first pilot passage and in said first control passage to connect said primary fluid source to said first pilot passage and said second relief passage to said second pilot passage;

(n) a second spool valve slidably positioned within said second bore and extending into both said first and second pilot passages, said second spool valve being movable in response to primary fluid in said second pilot passage to connect said source to said first main passage and said second relief passage to said second main passage and to primary fluid in said first pilot passage to connect said source to said second main passage and said first relief passage to said first main passage; and (o) a free piston positioned within said main bore and extending into said first and second main passages, said free piston responding to pressurized primary fluid present in said first main passage to move from a first position connecting said first and second control passages to said first fluid reservoir and said second bore through a series of positions drawing fluid from said reservoir through said first reservoir check valve and supplying fluid from said main bore through said second outlet check valve while respectively blocking said first and second control passages from said first and second main passages to a second position respectively connecting said first and second control passages to said second bore and said first fluid reservoir, said free piston responsive to primary fluid in said second main passage to move from said second position through a series of positions drawing fluid from said reservoir through said second reservoir check valve and supplying fluid from said main bore through said first outlet check valve to said first position.

4. The secondary fluid supply system of claim 3 including first and second seals are positioned between said first and second main passages and said first and second ends of said main bore, respectively, for sealingly encircling said first and second driving pistons.

* * * * *

UNITED STATES PATENT AND TRADEMARK OFFICE

CERTIFICATE OF CORRECTION

PATENT NO. : 4,388,049

DATED : 14 June 1983

INVENTOR(S) : Ronnie F. Burk

It is certified that error appears in the above-identified patent and that said Letters Patent is hereby corrected as shown below:

Column 5, line 65, delete "are".

Column 8, line 15, delete "are".

Signed and Sealed this

*Twenty-ninth* Day of *November 1983*

[SEAL]

*Attest:*

GERALD J. MOSSINGHOFF

*Attesting Officer*

*Commissioner of Patents and Trademarks*